US005621385A

United States Patent [19]

Carney

[11] Patent Number: 5,621,385

[45] Date of Patent: Apr. 15, 1997

[54] INTRUSION ALARM AND DETECTION SYSTEM

[76] Inventor: William P. Carney, 4 High Ridge La., Oyster Bay, N.Y. 11771

[21] Appl. No.: 506,420

[22] Filed: Jul. 24, 1995

Related U.S. Application Data

[63] Continuation-in-part of Ser. No. 239,468, May 9, 1994, abandoned.

[51] Int. Cl.[6] ..... G08B 13/00

[52] U.S. Cl. ..... 340/541; 341/176; 340/426

[58] Field of Search ..... 340/541, 573, 340/528, 527, 539, 692, 531, 522, 693, 546, 426; 364/709.15, 709.16; 341/176

[56] References Cited

U.S. PATENT DOCUMENTS

| | | | |
|---|---|---|---|
| 4,794,368 | 12/1988 | Grossheim | 340/426 |
| 5,469,151 | 11/1995 | Lavelle | 340/426 |
| 5,473,305 | 12/1995 | Hwang | 340/426 |

*Primary Examiner*—Jeffery Hofsass
*Assistant Examiner*—Albert K. Wong
*Attorney, Agent, or Firm*—Charles E. Temko

[57] ABSTRACT

An intrusion detection system used to surveil a predetermined space includes a monitor disposed within the space and a remote controller. The monitor contains an intrusion detector for sensing an intruder in the space and a memory circuit for recording any sensed intrusion. The remote controller includes an RF transmitter activated by a button switch the timed closure of which arms the monitor and the pulsed closure of which tests the monitor. The monitor produces an audible or a visual output in response to a test RF signal transmitted by the remote controller to indicate that an intrusion has not occurred. A pulsed closure of the button switch while the monitor is producing the output disarms the monitor. Should the monitor detect an intrusion and/or be disabled by the intruder, the lack of the monitor output in response to the test RF signal transmitted by the remote controller warns a returning occupant, before entering his or her premises, there exists the possibility of confronting an intruder.

8 Claims, 3 Drawing Sheets

INTRUSION ALARM AND DETECTION SYSTEM

CROSS REFERENCE TO RELATED APPLICATION

This is a Continuation-in-Part of U.S. patent application Ser. No. 08/239,468 filed May 9, 1994 now abandoned.

BACKGROUND OF THE INVENTION

1. Field of the Invention

This invention relates generally to alarm systems and more particularly to an intrusion alarm and detection system which monitors a predetermined space, initiates an alarm as a result of an intrusion into the predetermined space and records the occurrence of the intrusion. The system includes a reliable and substantially foolproof means by which to remotely arm, disarm and test for the occurrance of the intrusion without causing a false test report because a user inadvertently arms a disarmed system or disarms an armed system.

2. Description of Related Art

Burglar alarm systems which detect unauthorized entries into protected premises such as houses or apartments and produce audible or visual alarm signals as a result of such entries are well known. Automobile and personal property alarms which are remotely armed, disarmed and tested are also known in the art.

Typical house protection systems produce an audible or visual alert to warn occupants that an intrusion is occurring. If occupants are not at home, the alarm may or may not notify neighbors or police of a break-in. House alarm systems usually stop signalling after a predetermined period of time and, should no one respond to the alarm, occupants reenter their premises unaware of the possibility of confronting a remaining intruder.

For apartment buildings and other types of multiple occupancy dwellings, sonic burglar alarms are normally limited by local regulations to relatively short alarm time periods to avoid the nuisance of false alarms in densely populated premises. In small one or two room apartments, an intruder can easily find a concealed alarm in the process of producing an alert and quickly disable it. Neighbors may not hear the alarm and, even if they do, may not bother to inform the returning occupant of the break-in. The returning occupant enters his or her apartment not knowing that an intruder may be in their premises.

Remotely controlled automobile alarm systems are generally connected to a car's electrical system and utilize its horn and head lamps as alarm signals to discourage theft. Generally, a returning car owner is not as concerned about a remaining intruder as, for example, a returning apartment occupant since an intruder in an automobile can be observed by the owner before the owner reenters the vehicle whereas an intruder may remain unseen in an apartment.

The following United States Patents show prior art alarm systems of the type to which the present invention is applicable:

U.S. Pat. No. 4,794,368, which issued to Edward Grossheim and Michael Nykerk on Dec. 27, 1988 teaches an alarm system having three RF channels and a hand-held remote controller with three button switches. Pressing any one of the three buttons once or pressing any combination of the three buttons simultaneously controls up to seven distinct functions. Grossheim's disclosure does not address the problem of the user misusing the remote controller, thus, creating a false test response. False reports in systems such as Grossheim's may occur as a result of either the user pressing the wrong button or wrong combination of buttons or buttons being accidentally depressed. A false status report is a significant problem affecting the safety of the user particularly if the surveiled space is not visible to a returning occupant.

U.S. Pat. No. 4,897,630, a continuation-in-part of U.S. Pat. No. 4,794,368, which issued to Michael Nykerk on Jan. 30, 1990 discloses a computerized alarm system for detecting, signalling and reporting the occurrence of a penetration toward or an unauthorized entry into a defined area, such as an automobile. It also discloses a self-contained monitor intended to protect a variety of objects such as a boat, a trailer, a house, etc. and which communicates with a remote controller in a similar manner as taught in U.S. Pat. No. 4,794,368. Nykerk discloses a four button, four channel system wherein pressing any button once or pressing any combination of the buttons controls up to sixteen separate functions. A system which relies on selecting one of several buttons and pressing it once, or selecting a specific combination of buttons and pressing them simultaneously, to prompt a specific system response is expensive to manufacture and difficult to use particularly if the returning occupant has to operate the remote controller in a dimly lit or dark environment. Further, Nykerk discloses a system wherein an intruder is frightened away by a series of synthesized voice alarms but does not address the problem of an intruder remaining undetected in the surveiled space because the remote controller was misused thereby producing an incorrect test response.

As can be seen from the prior art, alarm systems for protecting automobiles, houses and apartments are complex, expensive and depend on various alarm schemes to frighten away would-be intruders. Existing systems do not specifically address the problems associated with self-contained intrusion detection monitors which are disposed to monitor spaces which cannot be seen by the system operator. In such applications, existing remotely controlled systems do not solve the problem of a returning occupant inadvertently either pressing the wrong button or combination of buttons and erasing the record of an intrusion or pressing the wrong button or combination of buttons and arming a disarmed system thereby causing a false report resulting in an encounter with an intruder.

It is apparent that there is a need for a cost-effective remotely controlled system which includes a minimum number of commercially available components, which consumes a minimum amount of electrical power and which can be integrated in a compact housing for convenient placement in an area to be surveiled. In addition, a system is needed that may be purchased and installed, for example, by an average apartment dweller, which is remotely controlled by a method that is easy to use, and substantially foolproof and which operates in a manner such that a returning occupant has a reliable method by which to test for a remaining intruder.

SUMMARY OF THE INVENTION

The present invention provides a novel intrusion detection and alarm system that is easy to install and which enables a returning occupant to determine, with a high degree of reliability, if his or her premises has been broken into before reentering the premises thereby avoiding an unwanted encounter with an intruder.

The present invention is an improved intrusion detection system of the type in which an intrusion is detected by a monitor having an RF receiver, a power supply, an intrusion detector, a logic circuit, a memory circuit and a responder. The monitor is disposed to surveil a predetermined space and the monitor has an armed state and a disarmed state and a user employs a hand held remote controller to arm and disarm the monitor. The improvement comprises the remote controller having a button switch for generating different code signals under the control of the user to permit the user to generate different select code signals. The monitor is armed by a first code signal from the remote controller, tested by a second code signal from the remote controller and disarmed by a disarm signal. The disarm signal is one member of a group of signals consisting of a power interruption sensed by the logic circuit and a third code signal transmitted by the remote controller.

DETAILED DESCRIPTION OF THE PREFERRED EMBODIMENT

Figure 1:
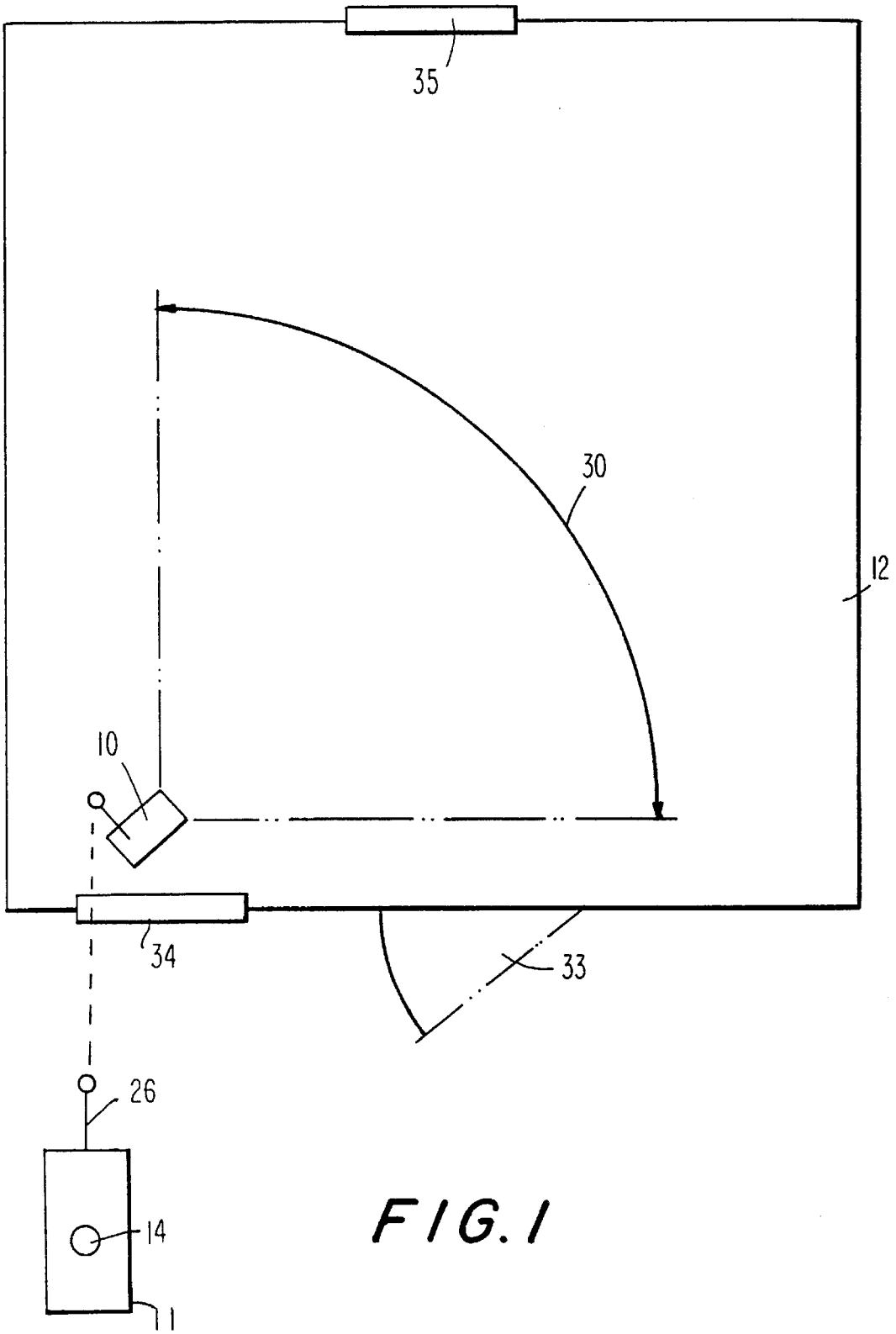
FIG. 1 is a plan view of the intrusion monitor disposed to surveil a premise. Also included in this figure is the remote controller.

Referring now to the drawings, FIG. 1 shows a view of the intrusion detection system used to monitor a typical predetermined space 12 for an intrusion. The space 12 includes a door 33 and may or may not include additional openings such as a front window 34 and a rear window 35 depending on the particular premises in which the system is deployed. The system comprises a remote controller 11 and a monitor 10. The remote controller 11 may be hand held, includes a button switch 14, and remotely controls the monitor 10 by transmitting a radio-frequency (RF) signal to the monitor 10. The monitor 10 is disposed within the predetermined space 12 and, as will be described in more detail below, is armed, disarmed, and tested by select code signals received from the remote controller 11 initiated by a user manipulating the button switch 14.

It is well known that monitors such as the monitor 10 described herein occasionally do not respond to every press of the remote controller button switch 14. Ambient electromagnetic interference, environmental conditions and other factors may result in the monitor 10 randomly failing to respond. Because of this phenomenon, users are generally uncertain as to whether the remote controller actually communicates with the receiver each time the remote is activated. For example, a remotely controlled garage door may not open the first time its associated remote controller button is pushed. In this case, the user repeatedly presses the remote until the door opens. The present invention, described hereinafter, employs a signalling arrangement wherein the monitor 10 is remotely armed, remotely tested and remotely disarmed by a substantially foolproof signalling protocol. One of the features of this foolproof signalling arrangement is that it prevents the user from either inadvertently arming a disarmed system or disarming an armed system because of the aforementioned tendency by the user to repeatedly press the remote when he or she is not sure whether the monitor 10 has received the transmitted signal.

As described more fully below, the monitor 10 surveils the predetermined space 12, produces an alarm signal when an intruder enters its detection pattern 30 and records an occurrence of the intrusion. The detection pattern 30, as shown in FIG. 1, is representative of detection patterns provided by typical commercially available intrusion detectors such as the detector used in the monitor 10. The memory status of the monitor 10 is tested through the use of the remote controller 11 to remotely determine if the monitor 10 is armed to detect and record the intrusion or if the intrusion has been detected and has been recorded. If the monitor 10 is armed and no intrusion has been recorded, a momentary closure or pulse of the test button switch 14 on the remote controller 11 causes the monitor 10 to produce an output signal such as a visible light or an audible sound indicating that it is safe to enter the predetermined space 12. If the intrusion has been recorded by the monitor 10, or if the intruder destroys, mutes, disables, interrupts power to, or removes the monitor 10 from the predetermined space 12, a momentary closure or pulse of the test button switch 14 results in no response from the monitor 10 indicating by lack of an output signal that it may not be safe to enter.

The output signal created by the monitor 10 and the location of the monitor 10 within the space 12 are at the user's discretion and depend on the layout of the premises in which it is disposed. A house may include the front window 34 and the rear window 35 making it convenient to position the monitor 10 near the front window 34 so that a visual output signal is easily observed by a returning occupant through the front window 34. An apartment in a multiple occupancy dwelling may not include the front window 34 and, in this premises, the monitor 10 may be disposed at a strategic location within the apartment such that an audible output signal is heard by a returning occupant through the door 33. Because the monitor 10 is lightweight and compact, a security conscious traveller may easily employ the system of the present invention to ensure that it is safe to reenter a motel room after returning from a late night supper. Individual travellers are often concerned about coming back to a motel room late at night, particularly if the room they rented was the only one available when they checked in and it is located with easy access to the public and/or is near a highway. Given such a location, it is important that the intrusion detection system provide the user a foolproof method of operation which permits repeatedly testing the state of the system in a noisy and/or dark environment without concern of inadvertently misusing the remote. What follows is a description of an embodiment of the present invention which provides a substantially foolproof system.

Figure 2:
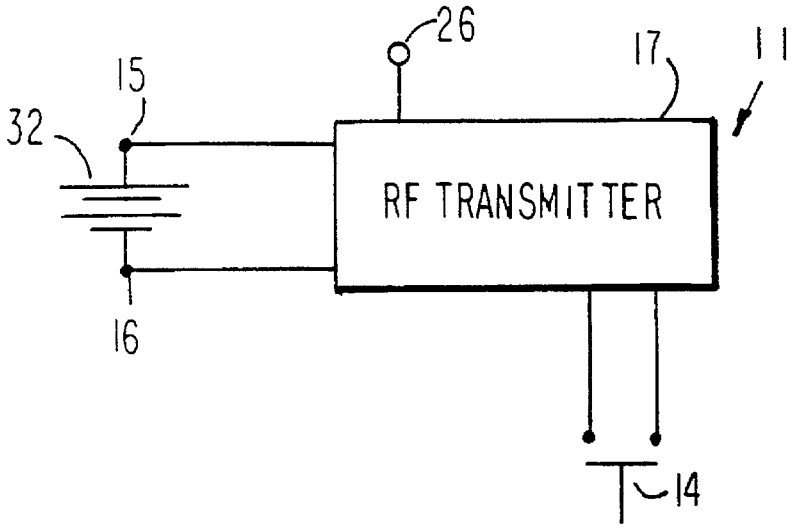
FIG. 2 is a schematic block diagram of the electrical circuit employed in the remote controller.

As shown in FIG. 1 and FIG. 2, the remote controller 11 includes a power supply such as a battery 32 which supplies a DC potential across its terminals 15 and 16 providing power to the RF transmitter 17 equipped with an antenna 26. The remote controller 11 is a commercially available one channel transmitting device that operates in a manner similar to a garage door remote having a button switch the depression of which causes an RF signal to be sent to a receiver in order to open a garage door. Off-the-shelf units are supplied with circuit means that enable the system manufacturer to tune the transmitter and receiver to the same radio frequency. The remote transmitter 17 of the present invention transmits the RF signal for as long as the button switch 14 is held closed.

As will be described in more detail below, the user of the remote controller 11 of the present invention signals the monitor 10 to perform a variety of functions by activating the button switch 14 in a prescribed manner. What follows is an example of a signalling protocol used to arm, test and disarm the monitor 10. The protocol presented herein is an example of a means by which the present invention enables the user to select code signals to direct the monitor 10 to perform several functions by activating only one button switch 14. For example, the signalling protocol could include, first, closing the switch 14 for a short time period (preferably 3 to 7 seconds) which causes a first code signal to be transmitted to the monitor 10. If the monitor 10 is disarmed, its detection pattern 30 is not being intruded and the monitor 10 is not producing an alarm signal, this first code signal arms the monitor 10. After releasing the button switch 14, the monitor 10 may be programmed to produce a response, indicating that it is armed. Alternatively, the button 14 may be held closed until the system produces the response. In either mode, the response notifies the user that he or she has held the button 14 depressed sufficiently long to arm the monitor. If the detection pattern 30 is being intruded, the system will fail to arm as a result of the first code signal and in order to arm the system, the intrusion must be cleared. Second, an armed system is tested by a momentary or pulsed (preferably 1 to 2 seconds) closure of the switch 14 which creates a second code signal that causes the monitor 10 to produce a test response (preferably 3 to 7 seconds) indicating that it is armed. Third, while the monitor 10 is in the process of producing either the aforementioned 3 to 7 second test response or the aforementioned alarm response, the user may disarm the system by pressing the remote button switch 14 once during the response. In other words, the monitor 10 is disarmed by a third code signal consisting of a momentary RF pulse generated by the user while the monitor 10 is in the process of responding. To summarize, the monitor 10 is armed by holding the button switch 14 closed for a short period of time, tested at any time by a momentary closure of the button switch 14 and disarmed by a momentary closure of the button switch 14 while the monitor 10 is producing either the test response or the alarm response. Unlike prior art systems, the user of the present invention selects the code signal (arm, disarm, test) transmitted by the remote controller 11 by the manner in which he or she manipulates the button switch 14 rather than by relying solely on either selecting and pressing an individual button from a plurality of buttons or selecting and pressing a combination of buttons as in the prior art.

The following is an illustration of how an apartment dweller may use the aforementioned signalling arrangement. When leaving his or her apartment, the departing occupant stands outside and presses the button switch 14 for approximately five seconds. Upon release of the button 14, the monitor 10 provides the test response or alternatively, the monitor responds while the button switch 14 is depressed indicating that the monitor 10 has been armed. Should the departing occupant wish to double-check system status, he or she can repeatedly single pulse button switch 14 to test the monitor 10 without concern that his or her last press of the button 14 on the remote controller 11 has changed the status of the system. When returning, the occupant remotely tests the system by a momentary closure of the switch 14. The lack of an output signal from the monitor 10 indicates that there has been an intrusion and it may not be safe to enter the premise.

Given this lack of a response, the returning occupant is immediately alerted to a questionable system condition. Because the remote controller button 14 has only been single pulsed, the user knows the status of the system has not been changed as a result of misusing the remote controller 11. Having been alerted to a possible intrusion, the returning occupant single pulses the button switch 14 again. Should there be no response, the returning occupant can seek help knowing the system has been violated, assured that a false indication of an intrusion is not being reported because the remote 11 was misused.

An output signal from the monitor 10 in response to the single pulse of RF transmitter 17 indicates there has not been an intrusion and it is safe to enter. Since the returning occupant has used only a momentary closure of the test button switch 14 to test the system, he or she need not worry that, through misuse of the remote 11, the monitor 10 has been accidentally rearmed and is producing an output signal falsely indicating it is safe to enter. If the returning occupant should enter his or her apartment and trigger the monitor, the alarm response may be turned off, as explained above, by the third code signal consisting of the momentary RF pulse generated by the user pressing the remote button 14 while the monitor 10 is in the process of responding.

Figure 3:
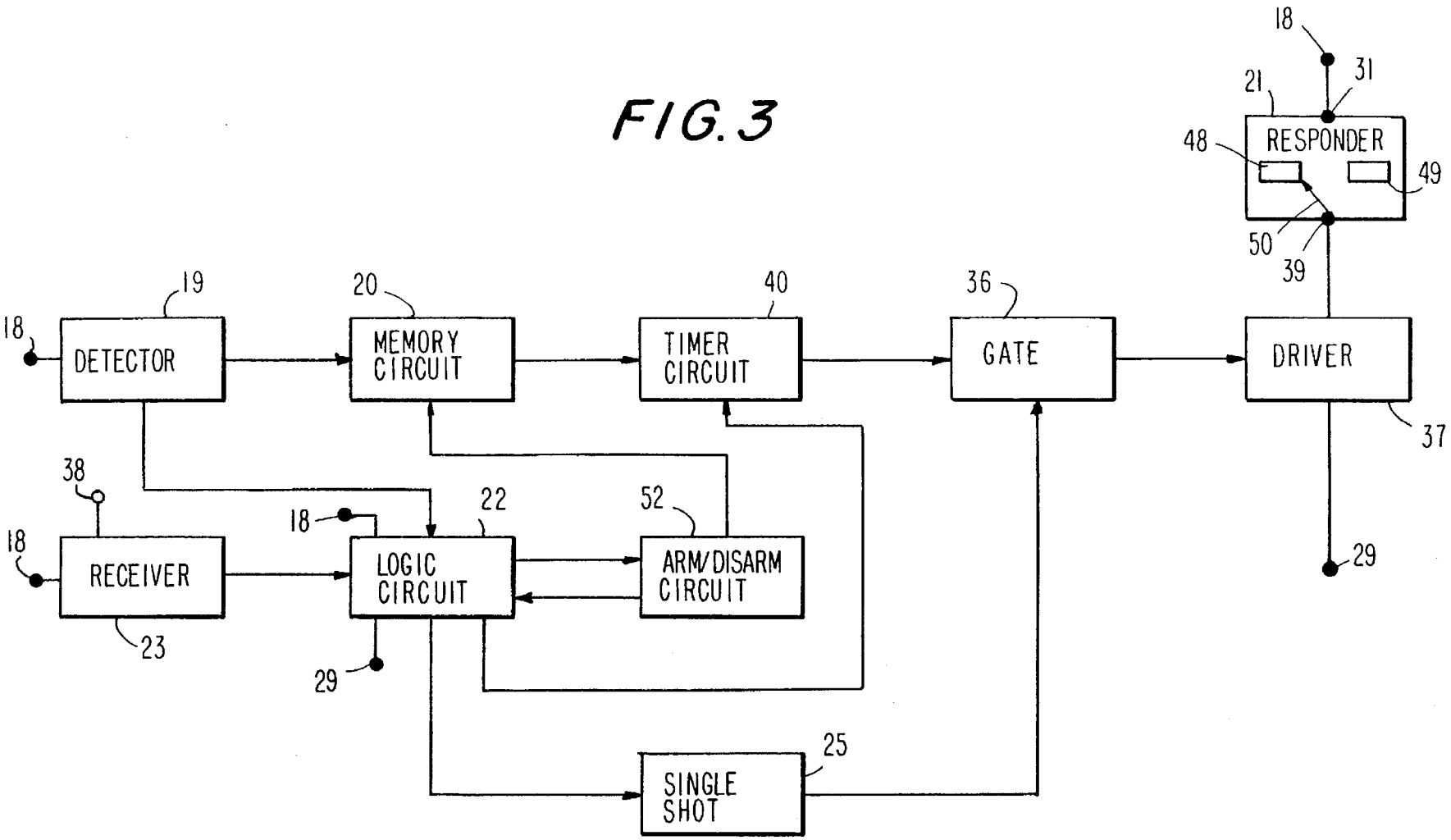
FIG. 3 is a schematic block diagram of the electrical circuit employed in the intrusion monitor.

As shown in FIG. 1, FIG. 2 and FIG. 3, the circuit of monitor 10 is equipped with a power supply such as a battery or an A.C. power line transformed and rectified to supply a D.C. potential across its positive terminals 18 and ground terminals 29. An RF receiver 23 is a commercially available one channel receiving device which, as previously described, operates in substantially the same manner as the receiver in a garage door opener system. The functions of a logic circuit 22, a memory circuit 20, an arm/disarm circuit 52, a timer circuit 40, a single shot 25, a gate 36 and a driver circuit 37 are integrated as part of a commercially available 8051 micro controller chip produced by any one of a number of solid state integrated circuit manufacturers such as Intel or Fujitsu. The logic circuit 22 senses the status of the devices that are connected to it and, as explained below, depending on the status of these devices, creates electrical signals directing one or more of them to react. An intrusion detector 19, a commercially available passive infrared device, detects an intrusion of an individual into its detection pattern 30 which causes its normally closed contacts to open. A responder 21 having commercially available signaling components, a buzzer 48 and a light 49, selectable through a switch 50, provides an audio signal or a visual signal in response to an electrical current flow in the monitor circuit between circuit points 31 and 39.

The circuit of monitor 10 is armed by a first code signal transmitted by the RF transmitter 17 initiated by the closure of the button switch 14. This closure causes a set of normally open contacts in the RF receiver 23, equipped with an antenna 38, to close for as long as the button switch 14 is held closed by the user. Logic circuit 22 notes this closure and tests the state of the detector 19 and the state of the arm/disarm circuit 52. If the normally closed contacts in the detector 19 are closed, if the arm/disarm circuit 52 is disarmed, and if the contacts in the receiver 23 stay closed for the predetermined time (as previously mentioned, preferably 3 to 7 seconds), the logic circuit 22 arms the monitor 10 by initiating an electrical arm/disarm signal which arms the arm/disarm circuit 52 and arms the memory circuit 20. Immediately upon release of the button switch 14, the logic circuit 22 directs the responder 21 to produce the timed test response thereby notifying the user that the monitor 10 is armed. Alternatively, the logic circuit 22 senses when the memory circuit becomes armed and directs the responder 21 to produce the response, thus notifying the user that the monitor 10 is armed. In either case, once armed, the status of the monitor 10 may be tested, at any time, by a pulsed closure of the button switch 14.

When the memory circuit 20 is tested by the pulsed closure of the switch 14, the RF receiver 23 is activated by the pulsed RF signal generated by the RF transmitter 17. The RF receiver 23 responds to this signal by a pulsed closure of its normally open contacts. The logic circuit 22 senses this pulsed closure and checks the status of the arm/disarm circuit 52. If the arm/disarm circuit 52 is armed, the logic circuit 22 initiates an electrical test signal which activates the single shot 25 thereby sending an electrical pulse through the gate 36 to the driver 37 causing current to flow in the responder 21. The selector switch 50 directs this electrical current flow between circuit points 39 and 31 through the buzzer 48 or the light 49 producing either an audible or a visual response of predetermined duration depending on the time setting of the single shot 25.

When an intrusion is detected, the normally closed contacts in the detector 19 open causing a power interruption to the logic circuit 22 thereby disarming the memory circuit 20 which in turn triggers the gate 36 causing a current of predetermined time duration, preferably set at between 1 to 5 minutes, to flow in the responder 21. The timer circuit 40 times this signal and stops current flow after the predetermined alarm time. After an intrusion has occurred, the monitor 10 will not produce a response to the test RF signal transmitted by the remote controller 11 because the memory circuit 20 has been switched to its disarmed state. The lack of an output in response to the test RF signal transmitted by the remote controller 11 is an indication that an intrusion has occurred.

The user can turn off the responder 21 and disarm the monitor 10 during the alarm response or the test response by a pulsed closure of the button switch 14. This pulsed closure of the button switch 14 causes a pulsed closure of the normally open contacts in the RF receiver 23. The logic circuit 22 senses this pulsed closure and if it also senses that the timer circuit 40 has been activated, the logic circuit 22 generates an electrical disarm signal which disarms the monitor 10 thereby stopping the current flow in the responder 21.

Should an intruder disregard the alarm or quickly note the location of the monitor 10 and interrupt or remove power across its terminals 18 and 29, the logic circuit 22 senses this power interruption and disarms the arm/disarm circuit 52. Once the arm/disarm circuit 52 is disarmed, it can only be rearmed, as explained above, by a unique signal initiated by a timed closure of the button switch 14. Without a remote controller tuned to the unique frequency required to activate the receiver 23, an intruder cannot rearm the system and fool a returning occupant into believing an intrusion has not occurred.

It is to be understood that the present invention is not limited to the precise details of structure shown and set forth in this specification, for obvious modifications will occur to those skilled in the art to which the invention pertains.

What is claimed is:

1. An improved intrusion detection system of the type in which an intrusion is detected by a monitor having an RF receiver, a power supply, an intrusion detector, a logic circuit, a memory circuit, and a responder, and in which said monitor is disposed to surveil a predetermined space, and in which said monitor has an armed state and a disarmed state and a user employs a hand held RF remote controller to arm and disarm said monitor, wherein the improvement comprises:

said remote controller having a button switch for generating a code signal under the control of said user;

said monitor being armed by said code signal of a predetermined duration from said remote controller;

said state of said monitor being tested by said code signal from said remote controller of a duration less than said predetermined duration; and said monitor being alternatively disarmed by either of said code signal from said remote controller when said responder is responding and the sensing of a power interruption by the logic circuit.

2. The improved intrusion detection system according to claim 1 wherein said code signal is transmitted by holding said button switch closed for a short period of time.

3. The improved intrusion detection system according to claim 1 wherein said code signal is transmitted by a momentary closure of said button switch thereby producing a response from said responder if said monitor is armed.

4. The improved intrusion detection system according to claim 1 wherein said power interruption is caused by said intrusion detector detecting said intrusion.

5. The improved intrusion detection system according to claim 1 wherein said code signal from said remote controller is caused by a momentary closure of said button switch thereby disarming said system when said responder is responding to an earlier transmitted signal.

6. The improved intrusion detection system according to claim 2 wherein said short period of time is preferably between three and seven seconds.

7. The improved intrusion detection system according to claim 3 wherein said momentary closure is preferably between one and two seconds.

8. A method for operating an intrusion detection system, said detection system comprising a remote controller and a monitor, said remote controller having a button switch, said monitor including a memory circuit having an armed and a disarmed state, said controller remotely arming, disarming and testing said memory circuit, said monitor having means for detecting and reporting an intrusion in a predetermined space, said method comprising the steps of:

a. arming said self-contained monitor by closing said remote controller button switch for a short period of time;

b. testing said monitor by a momentary closure of said button switch, thereby producing a test response from said monitor when armed;

c. monitoring said predetermined space to detect an unauthorized entry;

d. triggering said monitor from said armed state to said disarmed state in response to said unauthorized entry;

e. testing for an intrusion by a momentary closure of said switch to obtain a signal response from said self-contained monitor provided said intrusion has not occurred; and f. disarming said self-contained monitor by a momentary closure of said button switch while said responder is responding.

* * * * *